US009799989B1

(12) United States Patent
Zhu

(10) Patent No.: US 9,799,989 B1
(45) Date of Patent: Oct. 24, 2017

(54) ROTATING CONNECTOR AND ELECTRONIC CIGARETTES HAVING THE ROTATING CONNECTOR

(71) Applicant: Xiaochun Zhu, Shenzhen (CN)

(72) Inventor: Xiaochun Zhu, Shenzhen (CN)

( * ) Notice: Subject to any disclaimer, the term of this patent is extended or adjusted under 35 U.S.C. 154(b) by 0 days.

(21) Appl. No.: 15/206,308

(22) Filed: Jul. 10, 2016

(51) Int. Cl.
*H01R 13/62* (2006.01)
*H01R 13/631* (2006.01)
*H01R 13/639* (2006.01)
*A24F 47/00* (2006.01)

(52) U.S. Cl.
CPC ..... *H01R 13/631* (2013.01); *H01R 13/639* (2013.01); *A24F 47/008* (2013.01)

(58) Field of Classification Search
CPC . H01R 13/62933; H01R 13/213; H01R 33/46
USPC ..... 439/314, 372
See application file for complete search history.

(56) References Cited

U.S. PATENT DOCUMENTS 6,808,407 B1 * 10/2004 Cannon ..... H01R 13/625 439/314
9,282,772 B2 * 3/2016 Tucker ..... H01C 17/00
2007/0037430 A1 * 2/2007 Evans ..... H01R 13/625 439/314
2015/0118895 A1 * 4/2015 Zheng ..... H01R 13/66 439/529
2016/0157522 A1 * 6/2016 Zhu ..... F01K 5/00 131/329

* cited by examiner

*Primary Examiner* — Abdullah Riyami
*Assistant Examiner* — Thang Nguyen

(57) ABSTRACT

Present disclosure relates to a power connector assembly. The power connector assembly includes a vaporizer connector portion and a power module connector portion. The vaporizer connector portion includes a vaporizer connector body forming a negative terminal of the vaporizer connector portion and a locking mechanism. The power module connector portion includes a power module connector body forming a negative terminal of the power module connector portion and the locking mechanism. When locking mechanism of power module connector portion is engaged in a locking position with the locking mechanism of the vaporizer connector portion, a positive terminal of the power module connector portion is electrically coupled to a positive terminal of the vaporizer connector portion, and a negative terminal of the power module connector portion is electrically coupled to a negative terminal of the vaporizer connector portion, respectively, to provide electric power to the vaporizer connector portion from a power module.

19 Claims, 7 Drawing Sheets

ROTATING CONNECTOR AND ELECTRONIC CIGARETTES HAVING THE ROTATING CONNECTOR

FIELD

The present disclosure generally relates to the field of electronic cigarette, and more particularly to a rotating connector and electronic cigarettes having the rotating connector.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that smoking cigarette is harmful to smoker's health. The active ingredient in a cigarette is mainly nicotine. During smoking, nicotine, along with tar aerosol droplets produced in the cigarette burning, are breathed into the alveolus and absorbed quickly by the smoker. Once nicotine is absorbed into the blood of the smoker, nicotine then produces its effect on the receptors of the smoker's central nervous system, causing the smoker relax and enjoy an inebriety similar to that produced by an exhilarant.

The electronic cigarette is sometimes referred as electronic vaporing device, personal vaporizer (PV), or electronic nicotine delivery system (ENDS). It is a battery-powered device which simulates tobacco smoking. It generally uses a heating element that vaporizes a liquid solution (e-liquid). Some solutions contain a mixture of nicotine and a variety of flavorings, while others release a flavored vapor without nicotine. Many are designed to simulate smoking experience, such as cigarette smoking or cigar smoking. Some of them are made with similar appearance, while others are made considerably different in appearance.

Conventional electronic cigarettes have a power module screwed on a vaporizer body, it takes time to detach the power module for charging and/or attach the charged power module back onto the vaporizer body.

Therefore, an unaddressed need exists in the art to address the aforementioned deficiencies and inadequacies.

SUMMARY

In one aspect, the present disclosure relates to a vaporizer connector portion. In certain embodiments, the vaporizer connector portion includes: a vaporizer connector body, a positive terminal, and an insulation tube. The vaporizer connector body includes a locking mechanism. The locking mechanism is used to lock into a locking mechanism of a power module connector portion of a power module. The vaporizer connector body also forms a negative terminal of the vaporizer connector portion. When the locking mechanism vaporizer connector portion is engaged in a locking position with the locking mechanism of the power module connector portion, the positive terminal is electrically coupled to a corresponding positive terminal of the power module connector portion of the power module, and the negative terminal is electrically coupled to a corresponding negative terminal of the power module connector portion of the power module, respectively, to receive electric power from the power module.

In another aspect, the present disclosure relates to a power module connector portion of a power module. In certain embodiments, the power module connector portion include: a power module connector body, a positive terminal, and an insulation tube. The power module connector body includes a locking mechanism of the power module connector portion. The locking mechanism of the power module connector portion is configured to lock a locking mechanism of a vaporizer connector portion. The power module connector body also forms a negative terminal of the power module connector portion. When the locking mechanism is engaged in a locking position with the locking mechanism of the vaporizer connector portion, the positive terminal is electrically coupled to a corresponding positive terminal of the vaporizer connector portion, and the negative terminal is electrically coupled to a corresponding negative terminal of the vaporizer connector portion, respectively, to provide electric power to the vaporizer connector portion from the power module.

In yet another aspect, the present disclosure relates to a power connector assembly. In certain embodiments, the power connector assembly includes a vaporizer connector portion and a power module connector portion. The vaporizer connector portion includes a vaporizer connector body forming a negative terminal of the vaporizer connector portion, a positive terminal, an insulation tube, and a locking mechanism configured to lock into a locking mechanism of the power module connector portion. The power module connector portion includes a power module connector body forming a negative terminal of the power module connector portion, a positive terminal, an insulation tube, and the locking mechanism. When the locking mechanism of the power module connector portion is engaged in a locking position with the locking mechanism of the vaporizer connector portion, the positive terminal of the power module connector portion is electrically coupled to the positive terminal of the vaporizer connector portion, and the negative terminal of the power module connector portion is electrically coupled to the negative terminal of the vaporizer connector portion, respectively, to provide electric power to the vaporizer connector portion from a power module.

These and other aspects of the present disclosure will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
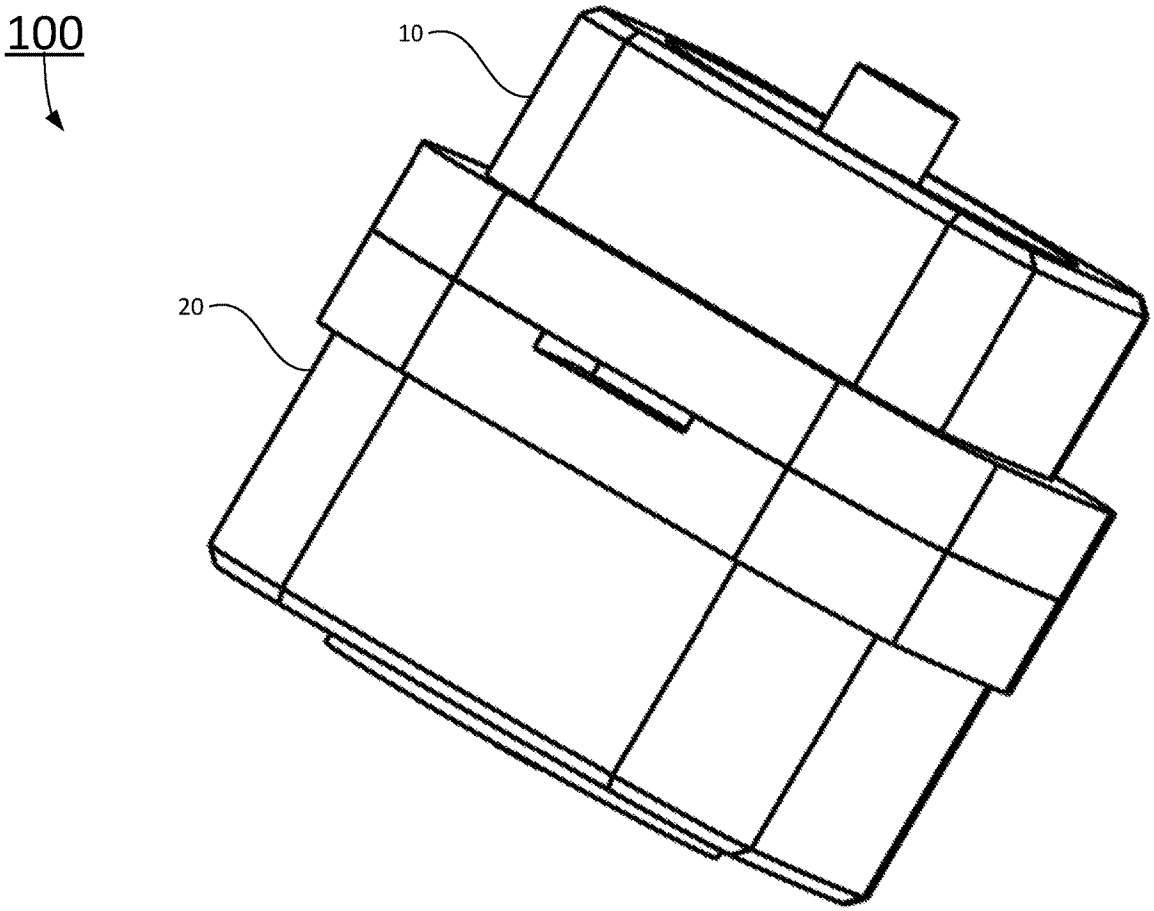
FIG. 1 is a perspective view of an exemplary power connector assembly having a vaporizer connector portion and a power module connector portion according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 5.

Referring now to FIG. 1, a perspective view of an exemplary power connector assembly 100 is shown according to certain embodiments of the present disclosure. In certain embodiments, the power connector assembly 100 includes a vaporizer connector portion 10 and a power module connector portion 20. Detailed description of the vaporizer connector portion 10 and the power module connector portion 20 are provided below in connection with the accompanying drawings FIGS. 2 through 5.

Figure 2B:
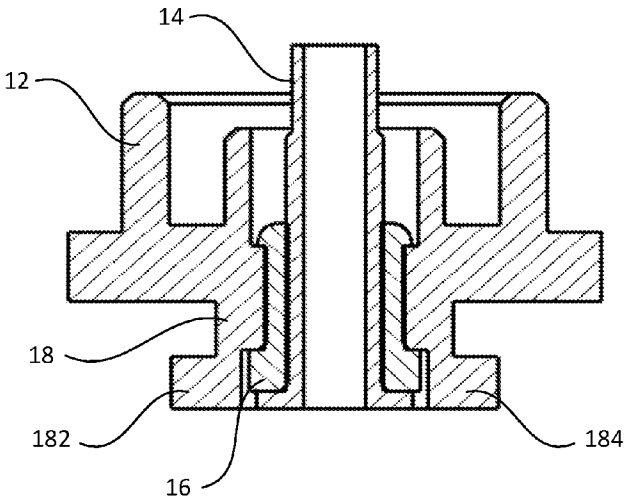
FIG. 2B is a cross-sectional view of the vaporizer connector portion of the power connector assembly.
Figure 2A:
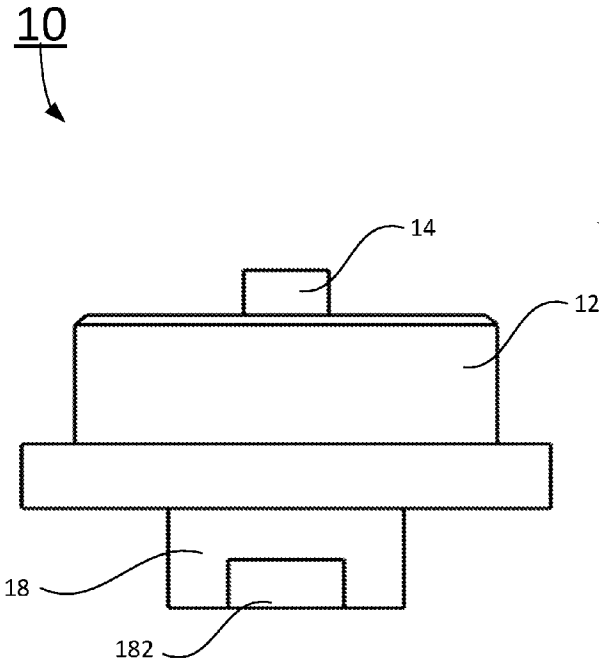
FIG. 2A is an external view of a vaporizer connector portion of the power connector assembly.
Figure 2C:
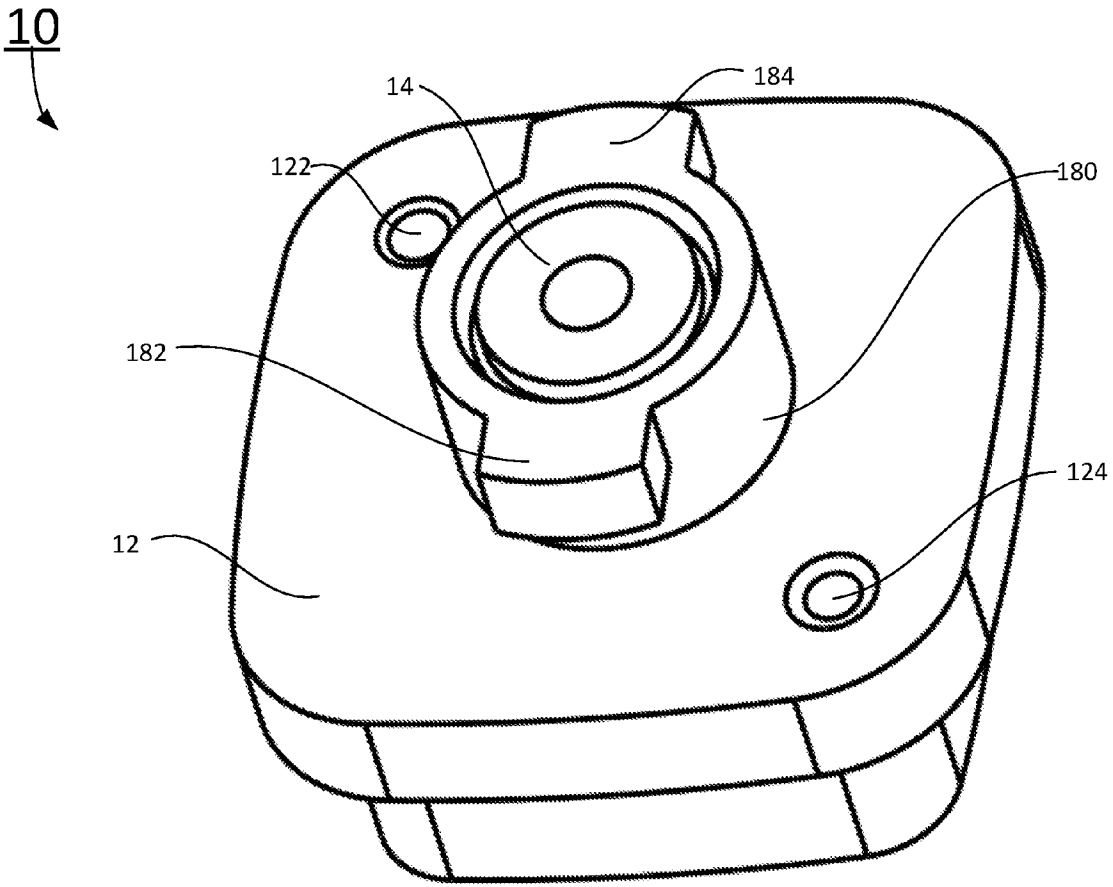
FIG. 2C is a bottom perspective view of the vaporizer connector portion of the power connector assembly according to certain embodiments of the present disclosure.

In one aspect, the present disclosure relates to a vaporizer connector portion 10. Referring now to FIGS. 2A, 2B, and 2C, an external side view, a cross-sectional view, and a bottom perspective view of the vaporizer connector portion 10 are shown, respectively, according to certain embodiments of the present disclosure.

In certain embodiments, the vaporizer connector portion 10 includes: a vaporizer connector body 12, a positive terminal 14, and an insulation tube 16. The vaporizer connector body 12 includes a locking mechanism 18. The locking mechanism 18 is used to lock into a locking mechanism 28 of a power module connector portion 20 of a power module. The vaporizer connector body 12 also forms a negative terminal 12 of the vaporizer connector portion 10. When the locking mechanism 18 vaporizer connector portion 10 is engaged in a locking position with the locking mechanism 28 of the power module connector portion 20, the positive terminal 14 is electrically coupled to a corresponding positive terminal 24 of the power module connector portion 20 of the power module, and the negative terminal 12 is electrically coupled to a corresponding negative terminal 22 of the power module connector portion 20 of the power module, respectively, to receive electric power from the power module.

In certain embodiments, the negative terminal 12 of the vaporizer connector portion 10 is configured to electrically couple to a negative terminal of a heating element of a vaporizer, and the positive terminal 14 of the vaporizer connector portion 10 is configured to electrically couple to a positive terminal of the heating element of the vaporizer, respectively.

In certain embodiments, the insulation tube 16 insulates the positive terminal 14 and the negative terminal 12 of the vaporizer connector portion 10.

In certain embodiments, the locking mechanism 18 of the vaporizer connector portion 10 includes a cylindrical body 180, a first locking hook 182, and an opposite second locking hook 184. When the locking mechanism 18 of the vaporizer connector portion 10 is inserted into the locking mechanism 28 of the power module connector portion 20 and is rotated a first angle in a first direction, the locking mechanism 18 of the vaporizer connector portion 10 is engaged in the locking position with the locking mechanism 28 of the power module connector portion 20 through the first locking hook 182 and the second locking hook 184 of the locking mechanism 18 of the vaporizer connector portion 10. In certain embodiments, the first angle is about 90 degrees. In one embodiment, the locking mechanism 18 of the vaporizer connector portion 10 is rotated in a clockwise direction. In another embodiment, the locking mechanism 18 of the vaporizer connector portion 10 is rotated in a counterclockwise direction.

In certain embodiments, the locking mechanism 18 of the vaporizer connector portion 10 further includes a first locking pin notch 122 and an opposite second locking pin notch 124. When the locking mechanism 18 of the vaporizer connector portion 10 is engaged in the locking position with the locking mechanism 28 of the power module connector portion 20, the first locking pin notch 122 and the second locking pin notch 124 of the vaporizer connector portion 10 are engaged with a first locking pin assembly 222 and a second locking pin assembly 224 of the locking mechanism 28 of the power module connector portion 20, respectively, to prevent relative rotation between the vaporizer connector portion 10 and the power module connector portion 20.

Figure 3B:
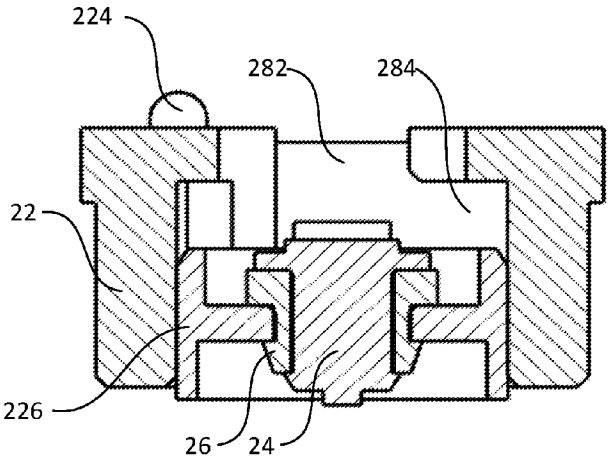
FIG. 3B is a cross-sectional view of the power module connector portion of the power connector assembly.
Figure 3A:
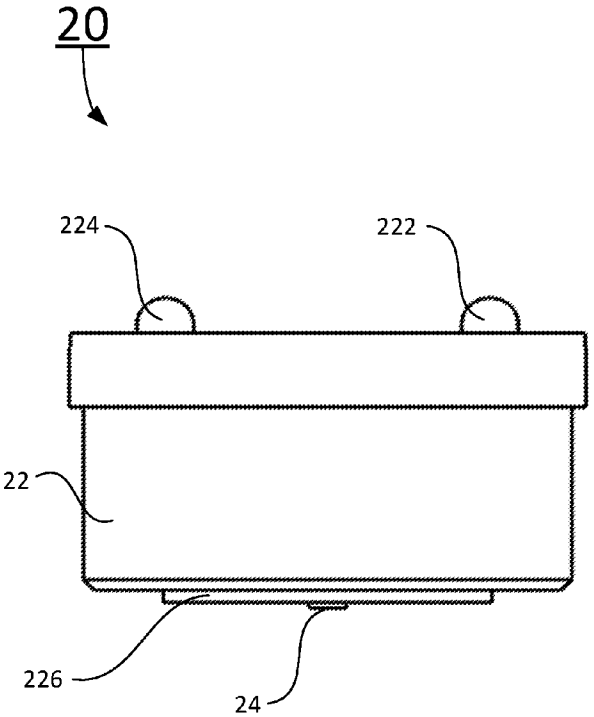
FIG. 3A is an external view of a power module connector portion of the power connector assembly.
Figure 3C:
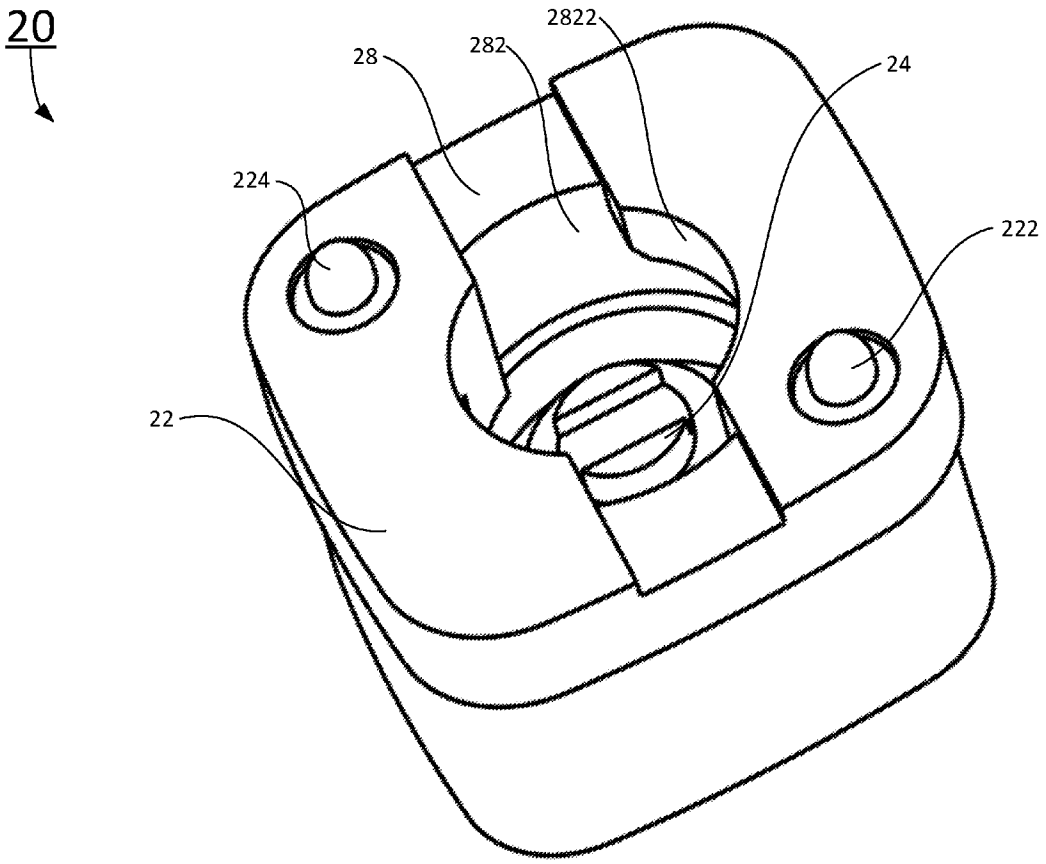
FIG. 3C is a top perspective view of the power module connector portion of the power connector assembly according to certain embodiments of the present disclosure.

In another aspect, the present disclosure relates to a power module connector portion 20 of a power module. Referring now to FIGS. 3A, 3B, and 3C, an external side view, a cross-sectional view, and a top perspective view of the power module connector portion 20 are shown, respectively, according to certain embodiments of the present disclosure.

In certain embodiments, the power module connector portion 20 include: a power module connector body 22, a positive terminal 24, and an insulation tube 26. The power module connector body 22 includes a locking mechanism 28 of the power module connector portion 20. The locking mechanism 28 of the power module connector portion 20 is configured to lock a locking mechanism 18 of a vaporizer connector portion 10. The power module connector body 22 also forms a negative terminal 22 of the power module connector portion 20. When the locking mechanism 28 is engaged in a locking position with the locking mechanism 18 of the vaporizer connector portion 10, the positive terminal 24 is electrically coupled to a corresponding positive terminal 14 of the vaporizer connector portion 10, and the negative terminal 22 is electrically coupled to a corresponding negative terminal 12 of the vaporizer connector portion 10, respectively, to provide electric power to the vaporizer connector portion 10 from the power module.

In certain embodiments, the negative terminal 22 of the power module connector portion 20 is electrically coupled to a negative terminal of the power module, and the positive terminal 24 of the power module connector portion 20 is electrically coupled to a positive terminal of the power module, respectively.

Figure 5:
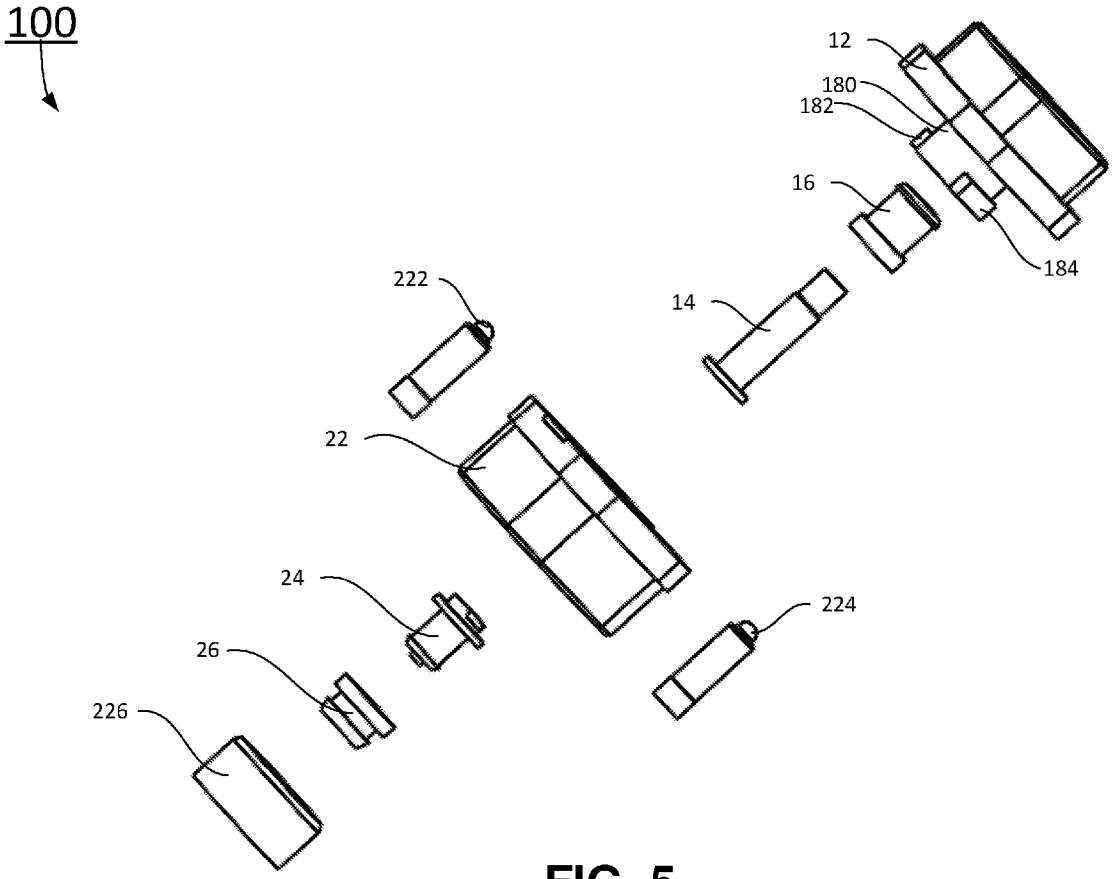
FIG. 5 shows an exploded perspective view of the power connector assembly of the power connector assembly according to certain embodiments of the present disclosure.

In certain embodiments, the insulation tube 26 of the power module connector portion 20 insulates the positive terminal 24 and the negative terminal 22 of the power module connector portion 20. A negative terminal support 226 is positioned between the negative terminal 22 and the insulation tube 26. The negative terminal support 226 holds the insulation tube 26 of the power module connector portion 20 in place as shown in FIGS. 3B and 5.

In certain embodiments, the locking mechanism 28 of the power module connector portion 20 defines a first locking opening 282 having a rectangle opening, and a second locking opening 284 defining a circular opening. A circular opening 2822 is further defined at the center of the first locking opening 282. The circular opening 2822 of the first locking opening 282 is configured to fit a cylindrical body 180 of the locking mechanism 18 of the vaporizer connector portion 10. The second locking opening 284 of the locking mechanism 28 of the power module connector portion 20 is configured to fit a first locking hook 182 and an opposite second locking hook 184 of the locking mechanism 18 of the vaporizer connector portion 10.

In certain embodiments, the locking mechanism 28 of the power module connector portion 20 includes a first locking pin assembly 222 and an opposite second locking pin assembly 224. When the locking mechanism 18 of the vaporizer connector portion 10 is engaged in the locking position with the locking mechanism 28 of the power module connector portion 20, the first locking pin assembly 222 and the second locking pin assembly 224 of the power module connector portion 20 are engaged in a first locking pin notch 122 and an opposite second locking pin notch 124 of the vaporizer connector portion 10, respectively, to prevent relative rotation between the vaporizer connector portion 10 and the power module connector portion 20.

Figure 4B:
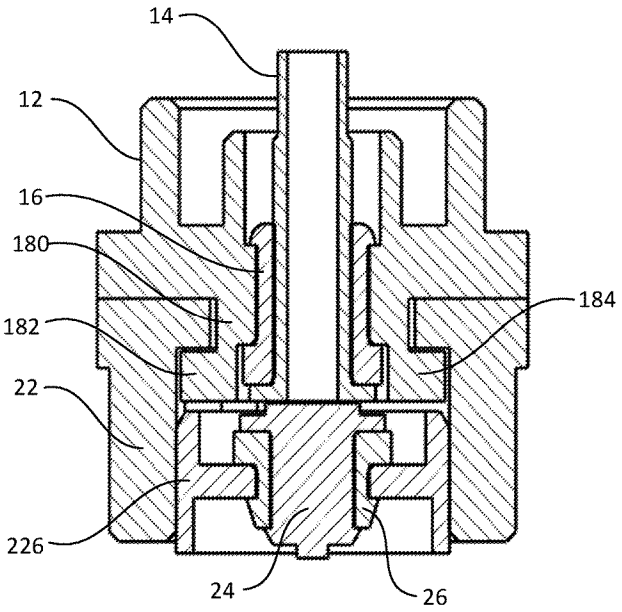
FIG. 4B is a cross-sectional view of the power connector assembly of the power connector assembly having the vaporizer connector portion and the power module connector portion engaged in the locking position according to certain embodiments of the present disclosure.
Figure 4A:
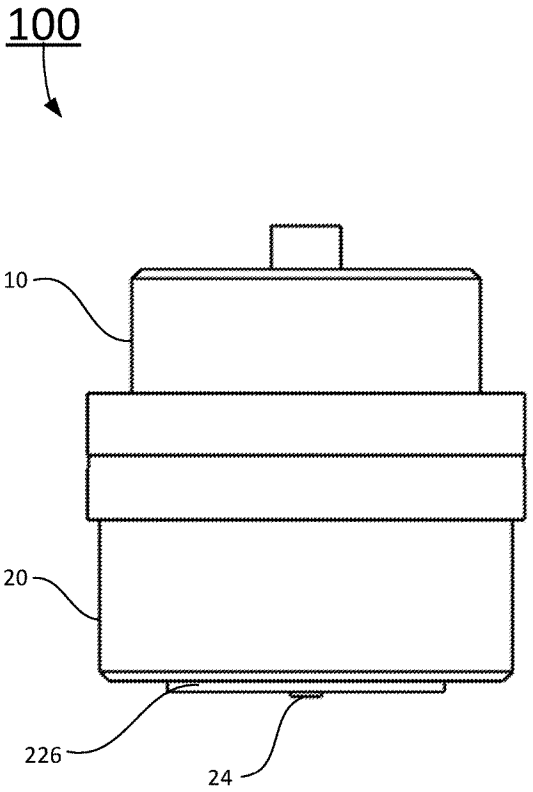
FIG. 4A is an external view of a power connector assembly of the power connector assembly having a vaporizer connector portion and a power module connector portion engaged in a locking position.

In yet another aspect, the present disclosure relates to a power connector assembly 100. Referring now to FIGS. 4A and 4B, and FIG. 1, an external side view, a cross-sectional view, and a perspective view of the power connector assembly 100 are shown, respectively, according to certain embodiments of the present disclosure.

In certain embodiments, the power connector assembly 100 includes a vaporizer connector portion 10 and a power module connector portion 20. The vaporizer connector portion 10 includes a vaporizer connector body 12 forming a negative terminal of the vaporizer connector portion 10, a positive terminal 14, an insulation tube 16, and a locking mechanism 18 configured to lock into a locking mechanism 28 of the power module connector portion 20. The power module connector portion 20 includes a power module connector body 22 forming a negative terminal of the power module connector portion 20, a positive terminal 24, an insulation tube 26, and the locking mechanism 28. When the locking mechanism 28 of the power module connector portion 20 is engaged in a locking position with the locking mechanism 18 of the vaporizer connector portion 10, the positive terminal 24 of the power module connector portion 20 is electrically coupled to the positive terminal 14 of the vaporizer connector portion 10, and the negative terminal 22 of the power module connector portion 20 is electrically coupled to the negative terminal 12 of the vaporizer connector portion 10, respectively, to provide electric power to the vaporizer connector portion 10 from a power module.

In certain embodiments, the negative terminal 12 of the vaporizer connector portion 10 is configured to electrically couple to a negative terminal of a heating element of a vaporizer, and the positive terminal 14 of the vaporizer connector portion 10 is configured to electrically couple to a positive terminal of the heating element of the vaporizer, respectively.

In certain embodiments, the insulation tube 16 of the vaporizer connector portion 10 is insulate the positive terminal 14 and the negative terminal 12 of the vaporizer connector portion 10. The insulation tube 26 of the power module connector portion 20 insulates the positive terminal 24 and the negative terminal 22 of the power module connector portion 20. A negative terminal support 226 is positioned between the negative terminal 22 and the insulation tube 26. The negative terminal support 226 holds the insulation tube 26 of the power module connector portion 20 in place as shown in FIGS. 4B and 5.

In certain embodiments, the locking mechanism 18 of the vaporizer connector portion 10 includes a cylindrical body 180, a first locking hook 182, and a second locking hook 184. The locking mechanism 28 defines a first locking opening 282 having a rectangle opening, and a second locking opening 284 having a circular opening. The first locking opening 282 further defines a circular opening 2822 at the center of the first locking opening 282. The circular opening of the first locking opening 282 of the locking mechanism 28 of the power module connector portion 20 is configured to fit the cylindrical body 180 of the locking mechanism 18 of the vaporizer connector portion 10, and the circular opening of the second locking opening 284 of the locking mechanism 28 of the power module connector portion 20 is configured to fit the first locking hook 182 and the second locking hook 184 of the locking mechanism 18 of the vaporizer connector portion 10.

In certain embodiments, the locking mechanism 18 of the vaporizer connector portion 10 is inserted into the locking mechanism 28 of the power module connector portion 20 with the first locking hook 182 and the second locking hook 184 along the rectangle opening and the cylindrical body 180 into the circular opening 2822 at the center of the first locking opening 282. After the locking mechanism 18 of the vaporizer connector portion 10 is inserted into the locking mechanism 28 of the power module connector portion 20, the locking mechanism 18 of the vaporizer connector portion 10 may be turned about 90 degrees to put the locking mechanism 18 of the vaporizer connector portion 10 into a locking position with the locking mechanism 28 of the power module connector portion 20. In one embodiment, the locking mechanism 18 of the vaporizer connector portion 10 is rotated in a clockwise direction. In another embodiment, the locking mechanism 18 of the vaporizer connector portion 10 is rotated in a counterclockwise direction.

In certain embodiments, the locking mechanism 18 of the vaporizer connector portion 10 includes a first locking pin notch 122 and an opposite second locking pin notch 124. The locking mechanism 28 of the power module connector portion 20 includes a first locking pin assembly 222 and a second locking pin assembly 224. When the locking mechanism 18 of the vaporizer connector portion 10 is engaged in the locking position with the locking mechanism 28 of the power module connector portion 20, the first locking pin assembly 222, and the second locking pin assembly 224 of the power module connector portion 20 are engaged in the first locking pin notch 122 and the second locking pin notch 124 of the vaporizer connector portion 10, respectively, to prevent relative rotation between the vaporizer connector portion 10 and the power module connector portion 20.

In certain embodiments, the present disclosure relates to an electronic cigarette having the power connector assembly 100 as described above.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims, the foregoing description and the exemplary embodiments described therein, and accompanying drawings.

What is claimed is:

1. A vaporizer connector portion, comprising:

a vaporizer connector body having a locking mechanism configured to lock into a locking mechanism of a power module connector portion of a power module, wherein the locking mechanism of the vaporizer connector body comprises a first locking pin notch and an opposite second locking pin notch, wherein the vaporizer connector body forms a negative terminal of the vaporizer connector portion, and the vaporizer connector body further comprises a positive terminal; and an insulation tube positioned between the vaporizer connector body and the positive terminal, wherein when the locking mechanism of the vaporizer connector body is engaged in a locking position with the locking mechanism of the power module connector portion of the power module, a first locking pin assembly, and a second locking pin assembly of the power module connector portion are engaged in the first locking pin notch and the second locking pin notch of the vaporizer connector body respectively to prevent relative rotation between the vaporizer connector portion and the power module connector portion, the positive terminal is electrically coupled to a corresponding positive terminal of the power module connector portion of the power module, and the negative terminal is electrically coupled to a corresponding negative terminal of the power module of the power module connector portion of the power module, respectively, to receive electric power from the power module.

2. The vaporizer connector portion of claim 1, wherein the negative terminal is configured to electrically couple to a negative terminal of a heating element of a vaporizer, and the positive terminal is configured to electrically couple to a positive terminal of the heating element of the vaporizer, respectively.

3. The vaporizer connector portion of claim 1, wherein the insulation tube insulates the positive terminal and the negative terminal.

4. The vaporizer connector portion of claim 1, wherein the locking mechanism comprises a cylindrical body; a first locking hook, and an opposite second locking hook, wherein when the locking mechanism is inserted into the locking mechanism of the power module connector portion and turned a first angle in a first direction, the locking mechanism is engaged in the locking position with the locking mechanism of the power module connector portion through the first locking hook and the second locking hook.

5. The vaporizer connector portion of claim 4, wherein the first angle is about 90 degrees, and the first direction comprises: a clockwise direction, and a counterclockwise direction.

6. An electronic cigarette comprising the vaporizer connector portion of claim 1.

7. A power module connector portion of a power module, comprising:

a power module connector body having a locking mechanism configured to lock a locking mechanism of a vaporizer connector portion, wherein the locking mechanism of the power module connector body comprises a first locking pin assembly and an opposite second locking pin assembly, wherein the power module connector body forms a negative terminal of the power module connector portion, and the vaporizer connector body further comprises a positive terminal; and an insulation tube supported by a negative terminal support and positioned between the vaporizer connector body and the positive terminal, wherein when the locking mechanism of the power module connector portion is engaged in a locking position with the locking mechanism of the vaporizer connector portion, the first locking pin assembly and the second locking pin assembly of the power module connector portion are engaged in a first locking pin notch and a second locking pin notch of the vaporizer connector body respectively to prevent relative rotation between the vaporizer connector portion and the power module connector portion, the positive terminal is electrically coupled to a corresponding positive terminal of the vaporizer connector portion, and the negative terminal is electrically coupled to a corresponding negative terminal of the vaporizer connector portion, respectively, to provide electric power to the vaporizer connector portion from the power module.

8. The power module connector portion of claim 7, wherein the negative terminal is electrically coupled to a negative terminal of the power module, and the positive terminal is electrically coupled to a positive terminal of the power module, respectively.

9. The power module connector portion of claim 7, wherein the insulation tube is configured to insulate the positive terminal and the negative terminal of the power module connector portion.

10. The power module connector portion of claim 7, wherein the locking mechanism defines a first locking opening having a rectangle opening, and a second locking opening having a circular opening.

11. The power module connector portion of claim 10, wherein the first locking opening further defines a circular opening at the center of the first locking opening configured to fit a cylindrical body of the locking mechanism of the vaporizer connector portion, and the circular opening of the second locking opening is configured to fit a first locking hook and an opposite second locking hook of the locking mechanism of the vaporizer connector portion.

12. An electronic cigarette comprising the power module connector portion of claim 7.

13. A power connector assembly, comprising:

a vaporizer connector portion having a vaporizer connector body, wherein the vaporizer connector body forms a negative terminal of the vaporizer connector portion, and the vaporizer connector body comprises a positive terminal of the vaporizer connector portion, an insulation tube positioned between the vaporizer connector body and the positive terminal, and a locking mechanism configured to lock into a locking mechanism of a power module connector portion of a power module, wherein the locking mechanism of the vaporizer connector body comprises a first locking pin notch and an opposite second locking pin notch;

the power module connector portion having a power module connector body wherein the power module connector body forms a negative terminal of the power module connector portion, and the power module connector body comprises a positive terminal, an insulation tube supported by a negative terminal support and positioned between the vaporizer connector body and the positive terminal, and the locking mechanism of the power module connector portion having a first locking pin assembly and an opposite second locking pin assembly, wherein when the locking mechanism of the power module connector portion is engaged in a locking position with the locking mechanism of the vaporizer connector portion, the first locking pin assembly and the second locking pin assembly of the power module connector portion are engaged in the first locking pin notch and the second locking pin notch of the vaporizer connector body respectively to prevent relative rotation between the vaporizer connector portion and the power module connector portion, the positive terminal of the power module connector portion is electrically coupled to the positive terminal of the vaporizer connector portion, and the negative terminal of the power module connector portion is electrically coupled to the negative terminal of the vaporizer connector portion, respectively, to provide electric power to the vaporizer connector portion from the power module.

14. The power connector assembly of claim 13, wherein the negative terminal of the vaporizer connector portion is configured to electrically couple to a negative terminal of a heating element of a vaporizer, and the positive terminal of the vaporizer connector portion is configured to electrically couple to a positive terminal of the heating element of the vaporizer, respectively.

15. The power connector assembly of claim 13, wherein the insulation tube of the vaporizer connector portion insulates the positive terminal and the negative terminal of the vaporizer connector portion.

16. The power connector assembly of claim 13, wherein the insulation tube of the power module connector portion insulates the positive terminal and the negative terminal of the power module connector portion.

17. The power connector assembly of claim 13, wherein the locking mechanism of the vaporizer connector portion comprises a cylindrical body; a first locking hook, and an opposite second locking hook;

wherein the locking mechanism of the power module connector portion defines a first locking opening having a rectangle opening, and a second locking opening having a circular opening, wherein the first locking opening further defines a circular opening at the center of the first locking opening;

wherein the circular opening of the first locking opening of the locking mechanism of the power module connector portion is configured to fit the cylindrical body of the locking mechanism of the vaporizer connector portion, and the circular opening of the second locking opening of the locking mechanism of the power module connector portion is configured to fit the first locking hook and the second locking hook of the locking mechanism of the vaporizer connector portion; and wherein when the locking mechanism of the vaporizer connector portion is inserted into the locking mechanism of the power module connector portion and turned a first angle in a first direction, the locking mechanism of the vaporizer connector portion is engaged in the locking position with the locking mechanism of the power module connector portion through the first locking hook and the second locking hook.

18. The power connector assembly of claim 13, wherein the first angle is about 90 degrees, and wherein the first direction comprises: a clockwise direction, and a counterclockwise direction.

19. An electronic cigarette comprising the power connector assembly of claim 13.

* * * * *